US012421639B2

(12) United States Patent
Liu et al.

(10) Patent No.: US 12,421,639 B2
(45) Date of Patent: Sep. 23, 2025

(54) VENTILATION CONTROL METHOD FOR LAUNDRY DEVICE

(71) Applicants: Qingdao Haier Laundry Electric Appliances Co., Ltd, Shandong (CN); Haier Smart Home Co., Ltd., Shandong (CN)

(72) Inventors: Kai Liu, Qingdao (CN); Sheng Xu, Qingdao (CN); Ziqiang Wang, Qingdao (CN); Mingli Zhou, Qingdao (CN)

(73) Assignees: QINGDAO HAIER LAUNDRY ELECTRIC APPLIANCES CO., LTD, Qingdao (CN); HAIER SMART HOME CO., LTD., Qingdao (CN)

( * ) Notice: Subject to any disclaimer, the term of this patent is extended or adjusted under 35 U.S.C. 154(b) by 259 days.

(21) Appl. No.: 18/250,635

(22) PCT Filed: Oct. 14, 2021

(86) PCT No.: PCT/CN2021/123666
§ 371 (c)(1),
(2) Date: Apr. 26, 2023

(87) PCT Pub. No.: WO2022/068946
PCT Pub. Date: Apr. 7, 2022

(65) Prior Publication Data

US 2023/0407541 A1 Dec. 21, 2023

(30) Foreign Application Priority Data

Oct. 30, 2020 (CN) ..... 202011192315.2

(51) Int. Cl.
*D06F 33/43* (2020.01)
*D06F 35/00* (2006.01)
(Continued)

(52) U.S. Cl.
CPC ..... *D06F 33/43* (2020.02); *D06F 35/008* (2013.01); *D06F 39/06* (2013.01); *D06F 39/088* (2013.01);
(Continued)

(58) Field of Classification Search
CPC ..... D06F 33/43; D06F 35/008; D06F 39/06; D06F 39/088; D06F 2103/44; D06F 2105/02; D06F 2105/54
See application file for complete search history.

(56) References Cited

U.S. PATENT DOCUMENTS 10,870,940 B2 * 12/2020 Boutiette ..... D06F 58/38
11,085,137 B2 * 8/2021 Salvi ..... D06F 37/304
(Continued)

FOREIGN PATENT DOCUMENTS

CN 101158101 A 4/2008
CN 106521876 A 3/2017
(Continued)

OTHER PUBLICATIONS

International Search Report (English translation included) dated Dec. 28, 2021, in corresponding International Application No. PCT/CN2021/123666, 4 pages.
(Continued)

*Primary Examiner* — Joseph L. Perrin
(74) *Attorney, Agent, or Firm* — Maier & Maier, PLLC

(57) ABSTRACT

A ventilation control method for a laundry device including: acquiring a present current of an air inflow fan when it is started; determining whether a water seal is formed by water in a water inflow pipe based on the present current, where when the present current reaches a preset current value, it indicates that the water seal is formed by water in the pipe, and when the present current does not reach the preset current value, it indicates that the water seal is not formed;
(Continued)

if the preset current value is reached, releasing the water seal by injecting water into the pipe to allow the water level to rise until the siphoning height is reached to trigger the siphon device to discharge the water in the pipe, and then ventilating the drum assembly; and if the preset current value is not reached, directly ventilating the drum assembly.

10 Claims, 3 Drawing Sheets

(51) Int. Cl.

| | |
|---|---|
| ***D06F 39/06*** | (2006.01) |
| ***D06F 39/08*** | (2006.01) |
| *D06F 103/44* | (2020.01) |
| *D06F 105/02* | (2020.01) |
| *D06F 105/54* | (2020.01) |

(52) U.S. Cl.
CPC ..... *D06F 2103/44* (2020.02); *D06F 2105/02* (2020.02); *D06F 2105/54* (2020.02)

(56) References Cited

U.S. PATENT DOCUMENTS

| | | | | |
|---|---|---|---|---|
| 11,208,755 | B2 * | 12/2021 | Balinski | D06F 58/38 |
| 11,913,160 | B2 * | 2/2024 | Balinski | D06F 39/04 |
| 12,060,671 | B2 * | 8/2024 | Damtew | D06F 39/12 |
| 2011/0041260 | A1 | 2/2011 | Balinski et al. | |
| 2018/0148882 | A1 * | 5/2018 | Leibman | H02K 1/32 |
| 2020/0283944 | A1 * | 9/2020 | Islas | D06F 23/02 |
| 2023/0059400 | A1 * | 2/2023 | Damtew | F24F 11/0001 |
| 2023/0160122 | A1 * | 5/2023 | Damtew | D06F 23/02 68/139 |

FOREIGN PATENT DOCUMENTS

| | | | |
|---|---|---|---|
| CN | 206873130 | U | 1/2018 |
| JP | 2017078555 | A | 4/2017 |
| JP | 2020081056 | A | 6/2020 |
| KR | 1020130051541 | A | 5/2013 |
| WO | 2017119594 | A1 | 7/2017 |
| WO | 2019228244 | A1 | 12/2019 |

OTHER PUBLICATIONS

Office Action issued on Apr. 1, 2025, in corresponding Chinese Application No. 202011192315.2, 10 pages.

* cited by examiner

VENTILATION CONTROL METHOD FOR LAUNDRY DEVICE

FIELD

The present disclosure belongs to the technical field of clothing washing, and specifically provides a ventilation control method for a clothing washing apparatus.

BACKGROUND

A clothing washing apparatus is a clothing treatment apparatus capable of washing, rinsing, spin-drying and/or drying the clothing.

Taking a drum washing machine and a drum washing-drying integrated machine as an example, they are designed according to the principle of striking clothing with a bar hammer, and have many advantages such as low wear, no entanglement, washability of cashmere and real silk fabrics, and large capacity, etc. After the clothing is washed, an interior of a drum assembly is very damp, and the damp environment makes it very easy to breed bacteria inside the drum assembly and will produce odor. However, just opening the door cannot eradicate this situation. When users use the washing machine again, secondary pollution will also be caused to the newly added clothing, which is not advantageous for use by users and will affect user's normal experience.

Accordingly, there is a need for a new ventilation control method for a clothing washing apparatus in the art to solve the above problems.

SUMMARY

In order to solve the above problems in the prior art, that is, to solve the problems in existing clothing washing apparatuses that the interior of the drum assembly thereof is very damp after the clothing is washed, which makes it easy to breed bacteria and produce odor, and that secondary pollution will be caused to the clothing to be washed subsequently, the present disclosure provides a ventilation control method for a clothing washing apparatus; the clothing washing apparatus includes a drum assembly, a clothing treatment agent dispenser and a water inflow pipe; an inlet of the water inflow pipe is communicated with the clothing treatment agent dispenser, and an outlet of the water inflow pipe is communicated with the drum assembly; the clothing washing apparatus further includes an air inflow pipe communicating the outside with the drum assembly, and a siphon device connected with the water inflow pipe; an air inflow fan is arranged in the air inflow pipe, and the siphon device is arranged to be capable of discharging water in the water inflow pipe when the water in the water inflow pipe reaches a siphoning height, so that the water inflow pipe is communicated with the outside; the ventilation control method includes: acquiring a present current of the air inflow fan when the air inflow fan is turned on; injecting water into the water inflow pipe if the present current of the air inflow fan reaches a preset current value, so as to trigger the siphon device to discharge the water in the water inflow pipe and then ventilating the drum assembly; and directly ventilating the drum assembly if the present current of the air inflow fan does not reach the preset current value.

In a preferred technical solution of the above ventilation control method, the water inflow pipe is a U-shaped water inflow pipe, the siphon device is a siphon pipe, and a siphoning trigger position of the siphon pipe is located between a height position of the inlet of the U-shaped water inflow pipe and a height position of the outlet of the U-shaped water inflow pipe.

In a preferred technical solution of the above ventilation control method, the siphon pipe is communicated with a bottom of a horizontal section of the U-shaped water inflow pipe.

In a preferred technical solution of the above ventilation control method, the drum assembly includes an outer cylinder, an inner drum rotatably arranged in the outer cylinder, and a window gasket connected with the outer cylinder, and the air inflow pipe is communicated with a wrinkle part of the window gasket.

In a preferred technical solution of the above ventilation control method, the air inflow pipe is communicated with a top of the wrinkle part of the window gasket.

In a preferred technical solution of the above ventilation control method, the drum assembly includes an outer cylinder, an inner drum rotatably arranged in the outer cylinder, and a window gasket connected with the outer cylinder, and the air inflow pipe is communicated with the outer cylinder.

In a preferred technical solution of the above ventilation control method, the air inflow pipe is communicated with a top of the outer cylinder.

In a preferred technical solution of the above ventilation control method, the air inflow pipe is provided therein with a foam overflow prevention member.

In a preferred technical solution of the above ventilation control method, the air inflow fan is arranged on an upstream side of the foam overflow prevention member in an air inflow direction of the air inflow pipe.

In a preferred technical solution of the above ventilation control method, the air inflow pipe is provided therein with an air filtering member.

It can be understood by those skilled in the art that in the preferred technical solutions of the present disclosure, the current of the air inflow fan is detected; if the current of the air inflow fan is too large, it indicates that a water seal is formed in the water inflow pipe, which hinders ventilation; by injecting water into the water inflow pipe and under the action of the air inflow fan, the water in the water inflow pipe can quickly reach the siphoning height, so that the water in the water inflow pipe is discharged by the siphon device to release the water seal, thus realizing ventilation; and if the current of the air inflow fan is not large, it indicates that there is no water seal formed in the water inflow pipe and ventilation is not hindered, so that ventilation can be directly achieved. Through this control method, the residual water inside the drum assembly can be air-dried after the clothing is washed, thus ensuring internal dryness of the drum assembly, and avoiding bacteria breeding and odor generation. Moreover, when the user uses the clothing washing apparatus to wash the clothing again, no secondary pollution will be caused to the clothing. In addition, there is no need to make significant structural changes to the clothing washing apparatus. The structure is simple, the production cost is saved, and the user experience is improved.

Further, the water inflow pipe is a U-shaped water inflow pipe, and the siphon device is a siphon pipe. When water flows into the U-shaped water inflow pipe, since the siphoning trigger position of the siphon pipe is higher than the outlet of the U-shaped water inflow pipe, the siphoning phenomenon will not be triggered during the inflow of water into the clothing washing apparatus, so that it is ensured the water in the U-shaped water inflow pipe can enter the drum assembly. When the clothing washing apparatus finishes washing and the ventilation program is executed, the air in the drum assembly enters the water inflow pipe, causing a water level of the water in the siphon pipe to continuously rise under the action of air pressure and water injection operation, until the siphon pipe is triggered to cause the siphoning phenomenon, so that the water in the water inflow pipe is discharged, and further the water inflow pipe is communicated with the outside to realize air discharge. Moreover, since the siphoning trigger position of the siphon pipe is lower than the inlet of the U-shaped water inflow pipe, the water in the U-shaped water inflow pipe will not flow back to the clothing treatment agent dispenser and overflow, thus ensuring the safe operation of clothing washing apparatus.

Further, the siphon pipe is communicated with the bottom of the horizontal section of the U-shaped water inflow pipe, so that when the clothing washing apparatus executes the ventilation program, the siphon pipe can completely drain the water in the U-shaped water inflow pipe, avoiding water residue in the U-shaped water inflow pipe.

Further, the arrangement of the foam overflow prevention member in the air inflow pipe can prevent foam from overflowing to the outside from the air inflow pipe if too much foam is generated in the washing process of the clothing washing apparatus, prevent water and foam from overflowing from the clothing washing apparatus, avoid affecting the indoor environment, and further improve the user experience.

Further, by arranging the air inflow fan on the upstream side of the foam overflow prevention member in the air inflow direction of the air inflow pipe, the air inflow fan can be prevented from being affected by foam and water, thus avoiding short circuit of the air inflow fan, and further improving the safety of the clothing washing apparatus.

Further, by arranging the air filtering member in the air inflow pipe, the air entering the drum assembly can be prevented from carrying impurities such as dust, thus ensuring that the interior of the drum assembly is not affected, and further improving the user experience.

BRIEF DESCRIPTION OF DRAWINGS

Specific embodiments of the present disclosure will be described below with reference to the accompanying drawings and in combination with a drum washing machine, in which.

DETAILED DESCRIPTION

First, it should be understood by those skilled in the art that these embodiments are only used to explain the technical principle of the present disclosure, and are not intended to limit the scope of protection of the present disclosure. For example, although the present disclosure is explained and described in connection with a drum washing machine, the technical principle of the present disclosure is obviously also applicable to other apparatuses, such as drum washing-drying integrated machines and shoe washers. Such adjustments and changes to the application object do not constitute limitations to the present disclosure, and should all be defined within the scope of protection of the present disclosure.

It should be noted that in the description of the present disclosure, terms indicating directional or positional relationships, such as "in", "above", "below", "horizontal", "vertical", "inner", "outer" and the like, are based on the directional or positional relationships shown in the accompanying drawings. They are only used for ease of description, and do not indicate or imply that the device or element must have a specific orientation, or be constructed or operated in a specific orientation; therefore, they should not be considered as limitations to the present disclosure.

In addition, it should also be noted that in the description of the present disclosure, unless otherwise clearly specified and defined, terms "arrange", "connect" and "communicate" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be internal communication between two elements. For those skilled in the art, the specific meaning of the above terms in the present disclosure can be interpreted according to specific situations.

In view of the problems pointed out in the "BACKGROUND" that in existing drum washing machines, the interior of the drum assembly thereof is very damp after the clothing is washed, which makes it easy to breed bacteria and produce odor, and that secondary pollution will be caused to the clothing to be washed subsequently, the present disclosure provides a ventilation control method for a drum washing machine, which aims to air-dry the residual water inside the drum assembly after the clothing is washed, thus ensuring internal dryness of the drum assembly, and avoiding bacteria breeding and odor generation; moreover, when the user uses the clothing washing apparatus to wash the clothing again, no secondary pollution will be caused to the clothing, and there is no need to make significant structural changes to the clothing washing apparatus. The structure is simple, the production cost is saved, and the user experience is improved.

Figure 1:
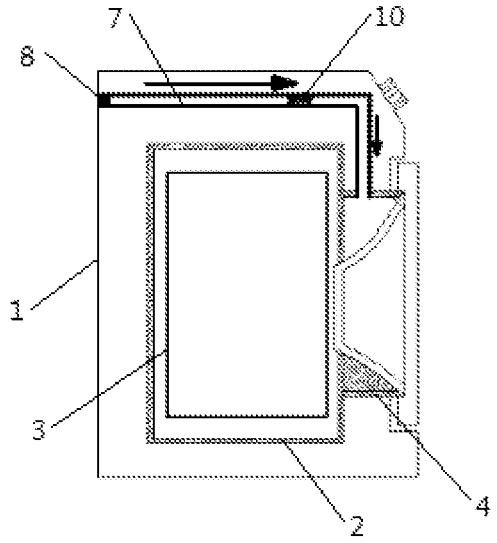
FIG. 1 is a first schematic structural view of a drum washing machine of the present disclosure.
Figure 2:
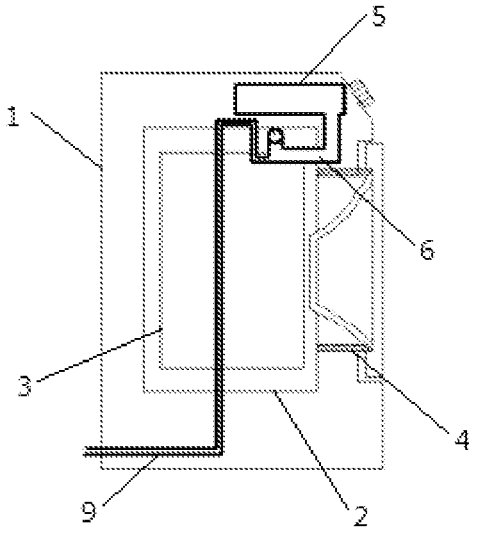
FIG. 2 is a second schematic structural view of the drum washing machine of the present disclosure.

Specifically, as shown in FIGS. 1 and 2, the drum washing machine of the present disclosure includes a cabinet 1 and a drum assembly arranged in the cabinet 1. The drum assembly includes an outer cylinder 2 suspended in the cabinet 1 by a plurality of elastic damping members, an inner drum 3 rotatably arranged in the outer cylinder 2, and a window gasket 4 connected with the outer cylinder 2. The window gasket 4 is also connected with a clothing throw-in port of the cabinet 1. The inner drum 3 is driven by a combination of motor and belt or by a direct drive motor. When a glass door of the drum washing machine is closed, it can closely fit with the window gasket 4 to achieve sealing. The drum washing machine also includes a clothing treatment agent dispenser 5 (such as a detergent box and a softener box) and a water inflow pipe. An inlet of the water inflow pipe is communicated with the clothing treatment agent dispenser 5, and an outlet of the water inflow pipe is communicated with the drum assembly. External water enters the clothing treatment agent dispenser 5; then, the clothing treatment agent and the water are injected together into the outer cylinder 2 through the water inflow pipe. The clothing treatment agent dispenser 5 is communicated with the outside. A height position of the inlet of the water inflow pipe is higher than a height position of the outlet of the water inflow pipe. The water inflow pipe is preferably communicated with the outer cylinder 2. When the drum washing machine executes a washing program, water is first injected into the outer cylinder 2 through the water inflow pipe until a washing water level is reached, and then water injection is stopped. At this point, there is still water in the water inflow pipe and water seal is formed.

As shown in FIG. 1, the drum washing machine of the present disclosure further includes an air inflow pipe 7 that communicates the outside with the drum assembly, and a siphon device connected with the water inflow pipe. The air inflow pipe 7 is provided therein with an air inflow fan 8, and the siphon device is arranged to be capable of discharging water in the water inflow pipe when the water in the water inflow pipe reaches a siphoning height, so that the water inflow pipe is communicated with the outside. The ventilation control method of the present disclosure includes: acquiring a present current of the air inflow fan 8 when the air inflow fan 8 is turned on; injecting water into the water inflow pipe if the present current of the air inflow fan 8 reaches a preset current value, so as to trigger the siphon device to discharge the water in the water inflow pipe and then ventilating the drum assembly; and directly ventilating the drum assembly if the present current of the air inflow fan 8 does not reach the preset current value. The preset current value is preferably the corresponding current value when a water seal is completely formed by the water in the water inflow pipe. By detecting and judging the preset current of the air inflow fan 8, it can be determined whether the water seal is formed by the water in the water inflow pipe. If the preset current of the air inflow fan 8 reaches the preset current value, it indicates that the water seal is formed by the water in the water inflow pipe, which hinders ventilation and causes the current of the air inflow fan 8 to be too large. At this point, water can be injected into the water inflow pipe, allowing the water level of the water in the water inflow pipe to quickly rise under the action of the air inflow fan 8 until the siphoning height is reached, so that the siphon device is triggered to discharge the water in the water inflow pipe. If the preset current of the air inflow fan 8 does not reach the preset current value, it indicates that the water seal is not formed by the water in the water inflow pipe. At this point, the air inflow fan 8 can directly achieve ventilation of the drum assembly. It should be noted that the preset current value can also be set as the corresponding current value when the water seal is almost formed by the water in the water inflow pipe. For example, when there is a lot of water in the water inflow pipe, although ventilation is not completely hindered, the ventilation capacity is also very limited at this point. In this situation, the water level in the water inflow pipe can also be quickly increased under the action of the air inflow fan by supplying water into the water inflow pipe, and then the water in the water inflow pipe can be discharged, so that an air circulation area in the water inflow pipe is increased to ensure subsequent ventilation operation. Those skilled in the art can flexibly set the condition of water seal corresponding to the preset current value in practical applications, as long as a boundary point determined by the preset current value can distinguish whether it is necessary to inject water into the water inflow pipe to trigger the siphoning phenomenon and release the water seal. The preset current value can be measured before the drum washing machine leaves the factory, or can also be measured the first time the drum washing machine is used after entering the user's home. In the above, a preferred way to inject water into the water inflow pipe is to directly open a water inflow valve of the drum washing machine, allowing external water to enter the clothing treatment agent dispenser from the water inflow valve before entering the water inflow pipe. Of course, other ways of injecting water can also be used, such as arranging a water inflow valve separately on the water inflow pipe to control the operation of injecting water into the water inflow pipe through the water inflow valve.

Figure 6:
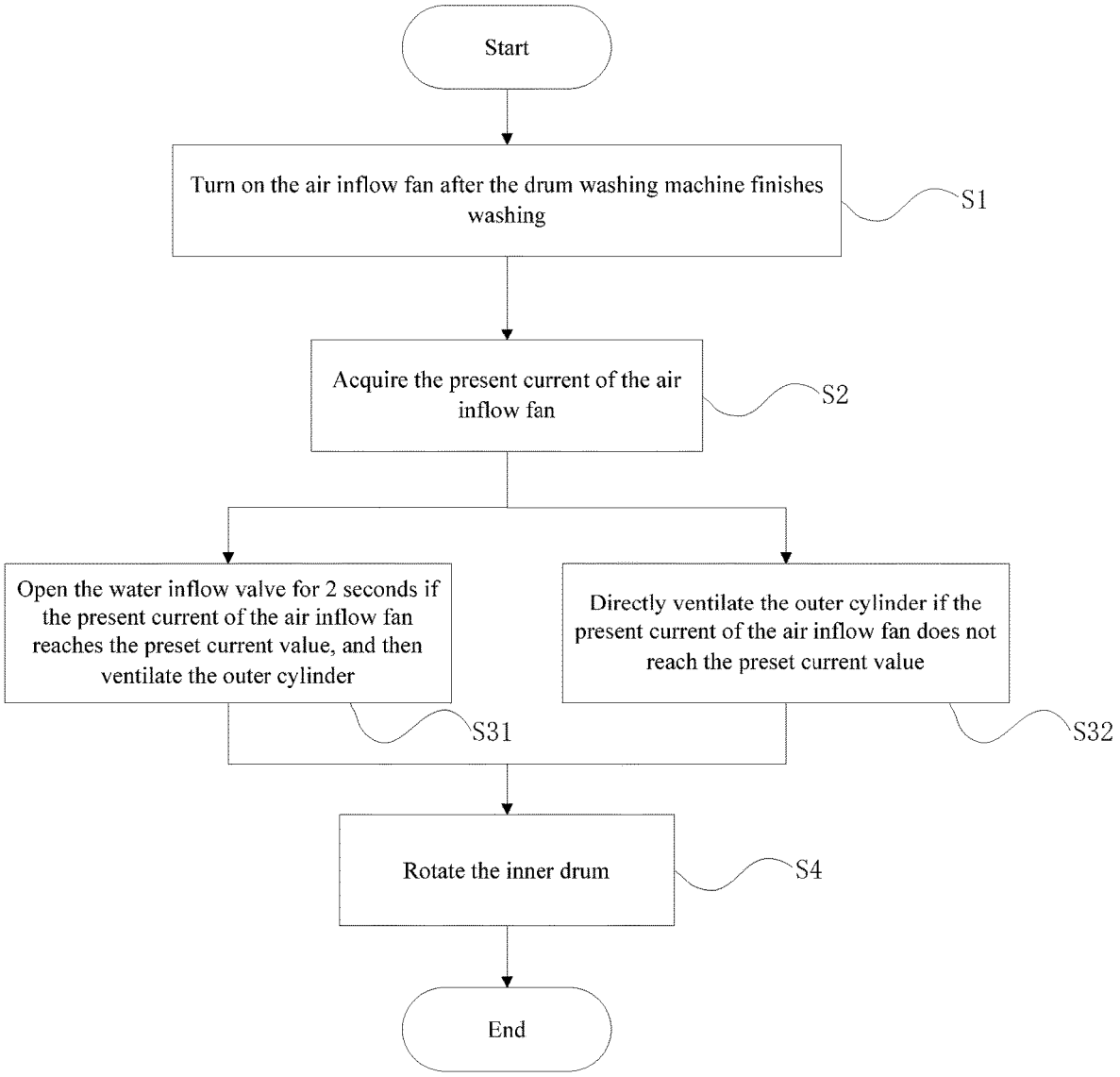
FIG. 6 is a flowchart of an embodiment of a ventilation control method for the drum washing machine of the present disclosure.

In a possible situation, as shown in FIG. 6, the ventilation control method of the present disclosure includes:

- S1: turning on the air inflow fan 8 after the drum washing machine finishes washing;
- S2: acquiring the present current of the air inflow fan 8;
- S31: opening the water inflow valve for 2 seconds if the present current of the air inflow fan 8 reaches the preset current value, and then ventilating the outer cylinder;
- S32: directly ventilating the outer cylinder if the present current of the air inflow fan 8 does not reach the preset current value; and
- S4: rotating the inner drum 3.

In step S4, if there is clothing in the inner drum 3, air drying of the drum assembly can also be achieved at the same time of shaking the clothing for loosing.

In step S31, in addition to directly setting the opening duration of the water inflow valve, a water level sensor can also be arranged in the water inflow pipe to detect the water level in the water inflow pipe. When the detected water level in the water inflow pipe reaches the siphoning height, the water inflow valve is controlled to be closed.

In a case where the water seal is formed in the water inflow pipe, after the air inflow fan 8 is turned on, outside air can be introduced into the outer cylinder 2 through the air inflow pipe 7, and the air in the outer cylinder 2 will enter the water inflow pipe. Due to the presence of water in the water inflow pipe and the formation of water seal, the water level in the siphon device will rise under the action of air pressure after the air enters the water inflow pipe. Moreover, in cooperation with the operation of injecting water into the water inflow pipe, the water level in the water inflow pipe rises quickly until the siphon device is triggered to siphon. The siphon device can discharge the water in the water inflow pipe, thus releasing the water seal in the water inflow pipe. The air in the outer cylinder 2 can continue to enter the clothing treatment agent dispenser 5 after entering the water inflow pipe. Since the clothing treatment agent dispenser 5 is communicated with the outside, the interior of the outer cylinder 2 is communicated with the outside, so as to achieve ventilation under the action of the air inflow fan 8, so that the interior of the drum assembly is air-dried and the odor in the drum assembly is discharged at the same time, thus avoiding bacteria breeding and secondary pollution to subsequent clothing washing.

Figure 3:
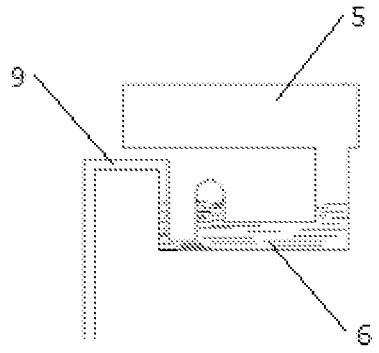
FIG. 3 is a first partial schematic view (water seal formed in U-shaped water inflow pipe) of the drum washing machine in the embodiment of the present disclosure.
Figure 4:
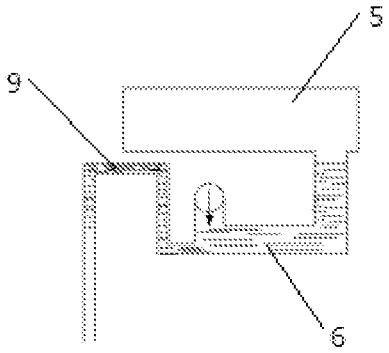
FIG. 4 is a second partial schematic view (water seal released by siphoning in U-shaped water inflow pipe) of the drum washing machine in the embodiment of the present disclosure.
Figure 5:
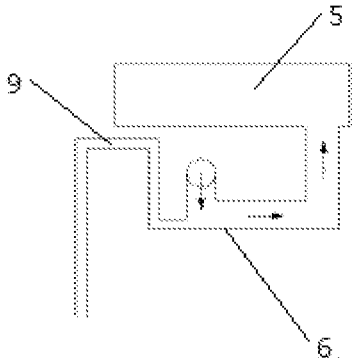
FIG. 5 is a third partial schematic view (air discharged from U-shaped water inflow pipe) of the drum washing machine in the embodiment of the present disclosure.

Preferably, as shown in FIGS. 1 to 5, the water inflow pipe is a U-shaped water inflow pipe 6, the siphon device is a siphon pipe 9, and a siphoning trigger position of the siphon pipe 9 is located between the height position of the inlet of the U-shaped water inflow pipe 6 and the height position of the outlet of the U-shaped water inflow pipe 6. When the drum washing machine is washing normally, water is first injected into the outer cylinder 2. The external water (usually coming from tap water) enters the clothing treatment agent dispenser 5, and then enters the U-shaped water inflow pipe 6 through the inlet of the U-shaped water inflow pipe 6. The water level in the U-shaped water inflow pipe 6 continuously rises, and the water enters the outer cylinder 2 through the outlet of the U-shaped water inflow pipe 6. The siphoning trigger position of the siphon pipe 9 is higher than the outlet of the U-shaped water inflow pipe 6. Due to the principle of communicating vessel, the water in the U-shaped water inflow pipe 6 can only enter the outer cylinder 2 without causing the siphon pipe 9 to be triggered to siphon; after water injection is completed, water is stored in the U-shaped water inflow pipe 6 and completely seals a horizontal section and at least part of a vertical section of the U-shaped water inflow pipe 6, that is, the U-shaped water inflow pipe 6 is water sealed (as shown in FIG. 3). When the drum washing machine executes the ventilation program, the air inflow fan 8 is turned on, and the outside air is introduced into the air inflow pipe 7 by the air inflow fan 8; then the air enters the outer cylinder 2. The air in the outer cylinder 2 will enter the U-shaped water inflow pipe 6 through the outlet of the U-shaped water inflow pipe 6, and then under the action of air pressure, a downward pressure is applied to the water in the U-shaped water inflow pipe 6 so that the water level in the siphon pipe 9 rises (as shown in FIG. 4). When aided by the operation of injecting water into the U-shaped water inflow pipe 6, the water level in the U-shaped water inflow pipe 6 will accelerate to rise until the siphoning trigger position (i.e., the siphoning height described above) is reached. The siphon pipe 9 discharges the water in the U-shaped water inflow pipe 6, so that the water seal in the U-shaped water inflow pipe 6 is released, thus enabling the air to enter the clothing treatment agent dispenser 5 through the inlet of the U-shaped water inflow pipe 6, and further be discharged to the outside (as shown in FIG. 5). Moreover, since the siphoning trigger position of the siphon pipe 9 is lower than the inlet of the U-shaped water inflow pipe 6, the water in the U-shaped water inflow pipe 6 will not enter the clothing treatment agent dispenser 5, and therefore the drum washing machine will not be subject to overflow. In the above, as an alternative, the U-shaped water inflow pipe 6 can also be replaced by a V-shaped water inflow pipe and other structures. Those skilled in the art can flexibly set the shape and structural form of the water inflow pipe according to the internal layout space of the drum washing machine in practical applications. Such adjustments and changes to the shape and structural form of the water inflow pipe do not constitute limitations to the present disclosure, and should all be defined within the scope of protection of the present disclosure. In a preferred case, the siphon pipe 9 is communicated with the bottom of the horizontal section of the U-shaped water inflow pipe 6. Through such an arrangement, the water in the U-shaped water inflow pipe 6 can be completely drained when the drum washing machine executes the ventilation program, so as to avoid water residue.

In addition, the air inflow pipe 7 can be communicated with the outer cylinder 2, and can also be communicated with a wrinkle part of the window gasket 4. Of course, it is most preferred that the air inflow pipe 7 is communicated with the wrinkle part of the window gasket 4. Through such an arrangement, the outside air can first enter the wrinkle part of the window gasket 4 before entering the outer cylinder 2, and can air-dry the wrinkle part of the window gasket 4 and the outer cylinder 2 at the same time, so that the interior of the drum assembly is air-dried with no dead corner, thus avoiding bacteria breeding inside the drum assembly. Moreover, there is no need for the user to repeatedly clean the drum assembly, and at the same time, secondary pollution to the clothing to be washed subsequently can be avoided. Further, when the air inflow pipe 7 is communicated with the outer cylinder 2, it is preferred that the air inflow pipe 7 is communicated with the top of the outer cylinder 2 to prevent the water in the outer cylinder 2 from flowing back into the air inflow pipe 7 during washing. When the air inflow pipe 7 is communicated with the wrinkle part of the window gasket 4, it is preferred that the air inflow pipe 7 is communicated with the top of the wrinkle part of the window gasket 4, which also prevents the water in the outer cylinder 2 from flowing back into the air inflow pipe 7 during washing.

Preferably, as shown in FIG. 1, a foam overflow prevention member 10 is arranged in the air inflow pipe 7, and the foam overflow prevention member 10 can be a one-way valve or a combined structure of dampers. For example, the foam overflow prevention member 10 includes a door, a first permanent magnet and a second permanent magnet. The door is rotatably arranged in the air inflow pipe, the first permanent magnet is arranged on the door, and the second permanent magnet is arranged on an upstream side of the door in the air inflow direction of the air inflow pipe. The magnetic properties of the first permanent magnet and the second permanent magnet are opposite. When the air inflow fan 8 is turned on, an air flow generated by the air inflow fan 8 can overcome the attraction between the first permanent magnet and the second permanent magnet to make the door rotate from a closed position to an open position, so that the outside air enters the outer cylinder 2. When the air inflow fan 8 is turned off, the door is kept in the closed position through the attraction between the first permanent magnet and the second permanent magnet, so as to prevent foam from overflowing. For another example, the foam overflow prevention member 10 includes a door, a first permanent magnet and a second permanent magnet. The door is rotatably arranged in the air inflow pipe, the first permanent magnet is arranged on the door, and the second permanent magnet is arranged on a downstream side of the door in the air flow direction of the air inflow pipe. The magnetic properties of the first permanent magnet and the second permanent magnet are the same. When the air inflow fan 8 is turned on, an air flow generated by the air inflow fan 8 can overcome a repulsive force between the first permanent magnet and the second permanent magnet to make the door rotate from a closed position to an open position, so that the outside air enters the outer cylinder 2. When the air inflow fan 8 is turned off, the door is kept in the closed position through the repulsive force between the first permanent magnet and the second permanent magnet, so as to prevent foam from overflowing. Of course, the first permanent magnet and the second permanent magnet described above can also be replaced by an elastic torsional spring, that is, the door is rotatably arranged in the air inflow pipe 7 through the elastic torsional spring. Turning on the air inflow fan 8 enables the door to open the air inflow pipe 7 against a torsional force of the elastic torsional spring. After the air inflow fan 8 is turned off, the elastic torsional spring resets the door to close the air inflow pipe 7. Those skilled in the art can flexibly set the specific structure of the foam overflow prevention member 10 in practical applications. Such adjustments and changes to the specific structure of the foam overflow prevention member 10 do not constitute limitations to the present disclosure, and should all be defined within the scope of protection of the present disclosure. In a preferred case, the air inflow fan 8 is arranged on the upstream side of the foam overflow prevention member 10 in the air inflow direction of the air inflow pipe 7. Through such an arrangement, the air inflow fan 8 will not contact the foam to cause short circuit, thus improving the safety of the drum washing machine.

Preferably, the air inflow pipe 7 is provided therein with an air filtering member. The air filtering member can be of a structure of a single-stage filter screen or a multi-stage filter screen, or be of other filtering structures, so as to prevent external dirt from entering the outer cylinder 2.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A ventilation control method for a clothing washing apparatus, wherein the clothing washing apparatus comprises a drum assembly, a clothing treatment agent dispenser and a water inflow pipe; an inlet of the water inflow pipe is communicated with the clothing treatment agent dispenser, and an outlet of the water inflow pipe is communicated with the drum assembly; the clothing washing apparatus further comprises an air inflow pipe communicating outside of the clothing washing apparatus with the drum assembly, and a siphon device connected with the water inflow pipe; an air inflow fan is arranged in the air inflow pipe, and the siphon device is arranged to be capable of discharging water in the water inflow pipe when water in the water inflow pipe reaches a siphoning height, so that the water inflow pipe is communicated with the outside of the clothing washing apparatus;

the ventilation control method comprising:

acquiring a present current of the air inflow fan when the air inflow fan is turned on;

determining whether a water seal is formed by water in the water inflow pipe based on the present current, wherein when the present current reaches a preset current value, it indicates that a water seal is formed by the water in the water inflow pipe, and wherein when the present current does not reach the preset current value, it indicates that the water seal is not formed by the water in the water inflow pipe;

if the preset current value is reached, releasing the water seal by injecting water into the water inflow pipe to allow the water level of the water in the water inflow pipe to rise under the action of the air inflow fan until the siphoning height is reached to trigger the siphon device to discharge the water in the water inflow pipe, and then ventilating the drum assembly; and the preset current value is not reached, directly ventilating the drum assembly.

2. The ventilation control method according to claim 1, wherein the water inflow pipe is a U-shaped water inflow pipe, the siphon device is a siphon pipe, and a siphoning trigger position of the siphon pipe is located between a height position of the inlet of the U-shaped water inflow pipe and a height position of the outlet of the U-shaped water inflow pipe.

3. The ventilation control method according to claim 2, wherein the siphon pipe is communicated with a bottom of a horizontal section of the U-shaped water inflow pipe.

4. The ventilation control method according to claim 1, wherein the drum assembly comprises an outer cylinder, an inner cylinder rotatably arranged in the outer cylinder, and a window gasket connected with the outer cylinder, and the air inflow pipe is communicated with a wrinkle part of the window gasket.

5. The ventilation control method according to claim 4, wherein the air inflow pipe is communicated with a top of the wrinkle part of the window gasket.

6. The ventilation control method according to claim 1, wherein the drum assembly comprises an outer cylinder, an inner cylinder rotatably arranged in the outer cylinder, and a window gasket connected with the outer cylinder, and the air inflow pipe is communicated with the outer cylinder.

7. The ventilation control method according to claim 6, wherein the air inflow pipe is communicated with a top of the outer cylinder.

8. The ventilation control method according to claim 1, wherein the air inflow pipe is provided therein with a foam overflow prevention member.

9. The ventilation control method according to claim 8, wherein the air inflow fan is arranged on an upstream side of the foam overflow prevention member in an air inflow direction of the air inflow pipe.

10. The ventilation control method according to claim 1, wherein the air inflow pipe is provided therein with an air filtering member.

* * * * *